United States Patent [19]

Ciaffone

[11] 4,392,303

[45] Jul. 12, 1983

[54] ONE-PIECE RAZOR HANDLE

[75] Inventor: John T. Ciaffone, Bridgeport, Conn.

[73] Assignee: Warner-Lambert Company, Morris Plains, N.J.

[21] Appl. No.: 290,263

[22] Filed: Aug. 5, 1981

Related U.S. Application Data

[63] Continuation of Ser. No. 108,742, Dec. 31, 1979, abandoned.

[51] Int. Cl.[3] ..... B26B 21/52

[52] U.S. Cl. ..... 30/85

[58] Field of Search ..... 30/85, 86, 87, 89, 90, 30/50, 48; 81/43

[56] References Cited

U.S. PATENT DOCUMENTS 2,911,711 11/1959 Loughlin ..... 30/85 X 4,226,459 10/1980 Natalicio ..... 81/43 X

FOREIGN PATENT DOCUMENTS 2064408 6/1981 United Kingdom ..... 30/85

*Primary Examiner*—James G. Smith

*Assistant Examiner*—Willman Fridie, Jr.

*Attorney, Agent, or Firm*—R. S. Strickler; S. A. Schneeberger

[57] ABSTRACT

A one-piece razor handle molded from resilient plastic has spaced-apart opposing side walls joined at an intermediate location by a neck. The walls diverge upwardly from the neck into upper portions for gripping a blade cartridge, and extend downwardly to a spacer that extends between the lower portions of the wall. The lower portions of the walls, between the neck and spacer, are resiliently squeezable. The neck acts as a fulcrum so that the upper portions pivot outwardly as the lower portions are squeezed inwardly. A base joins the bottoms of the walls extending past the spacer.

1 Claim, 5 Drawing Figures

ONE-PIECE RAZOR HANDLE

This is a continuation of application Ser. No. 108,742 filed Dec. 31, 1979, now abandoned.

BACKGROUND

This invention relates to wet shaving systems using blade cartridges and particularly to razor handles adapted for engaging blade cartridges.

Most wet shaving systems available today use blade cartridges rather than blades alone as the replaceable elements of the system. The cartridges allow precise location and orientation of the blade in its support structure, and are even more necessary for the use of dual blade systems, where two cutting edges are located in a cartridge in a precise relationship.

A number of techniques are used for attaching cartridges to razor handles. One method is to provide the razor handle with a pair of spreadable jaws for engaging projections in the rear of the blade cartridge. The jaws are spread, the cartridge is inserted between the jaws, and the jaws are closed to engage the cartridge projections. Typically some mechanism in the razor handle is needed to spread apart the jaws for insertion and/or removal of the cartridge from the handle.

It is an object of this invention to provide a razor handle that is simple and easy to use both to attach the handle to a blade cartridge, and also to disengage the handle from a used blade cartridge. It is another object to provide a razor handle for engagement and disengagement of a blade cartridge that is inexpensive to manufacture. Another object is to provide a razor handle that is adapted to engage and disengage blade cartridges with a variety of surfaces, and to engage them securely and safely. Still another object is to provide a razor handle that may be used to convert pivotable cartridges, meant for handles that allow them to pivot during shaving, to the non-pivotable, or fixed, engagement that some users prefer.

SUMMARY OF THE INVENTION

A razor handle has a pair of spaced-apart opposing elongate side walls that have a portion intermediate their length that defines a fulcrum about which they are pivotable. The upper portions of the walls extending up from the fulcrum are engageable with a razor blade cartridge. The lower portions, extending downwardly from the fulcrum, are squeezable to pivot the upper portions outwardly out of engagement with the cartridge.

In preferred embodiments, the handle portion joins side walls, the handle is made from a resilient plastic, and the lower portions of the side walls, between the fulcrum and a spacer joining the lower portions below the fulcrum, are resiliently squeezable toward each other. Preferred embodiments are also characterized by a base joining the bottoms of the walls extending beyond the spacer to allow the handle to be gripped without disengaging the cartridge. The cartridge engaging upper portions of the walls, in the preferred embodiment, include surfaces for abutting the cartridge to prevent it from pivoting.

BRIEF DESCRIPTION OF THE DRAWING

Other objects, features and advantages of the invention will be pointed out or will be readily apparent in the following description of a preferred embodiment of the invention, including the drawing, in which.

DESCRIPTION OF THE PREFERRED EMBODIMENT

Figure 1:
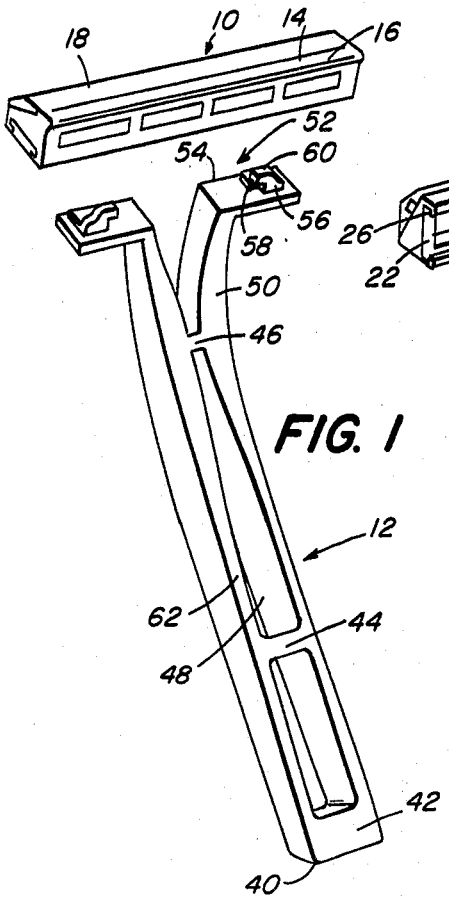
FIG. 1 is a perspective view, from the front, of a razor blade cartridge and a razor handle constructed according to the invention.
Figure 2:
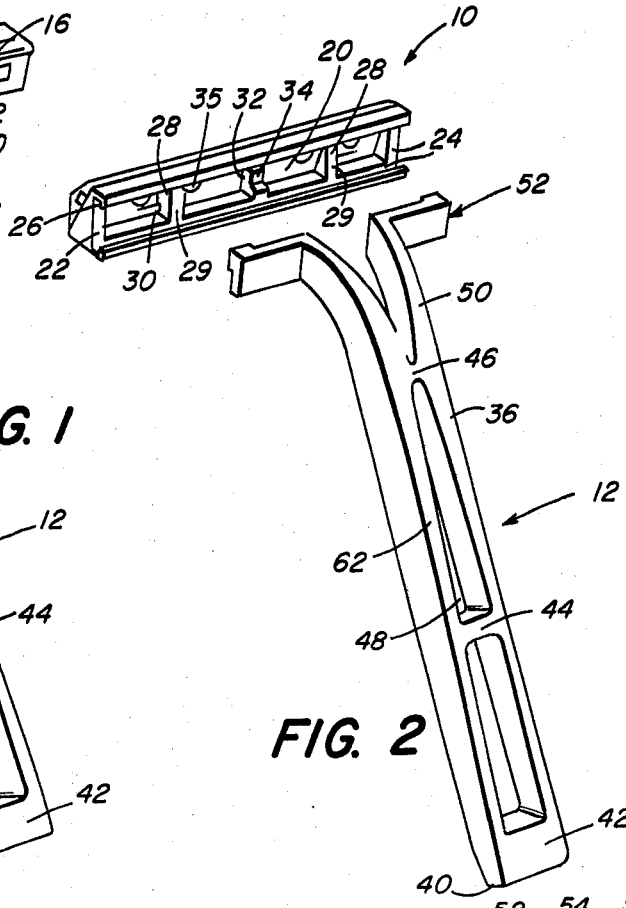
FIG. 2 is a perspective view, from the rear, of the cartridge and handle of FIG. 1.

FIGS. 1 and 2 show a typical razor blade cartridge 10 and a razor handle 12 constructed according to the invention. The cartridge 10 is of the type that has two parallel blades 14 mounted in the cartridge to present parallel, spaced-apart, cutting edges 16 on the front shaving surface 18 of the cartridge (see FIG. 1). The rear surface 20 of the blade cartridge 10 (see FIG. 2) includes portions for engagement with various razor handles, including a horizontal slot 22 made up of peripheral vertical walls 24 and upper and lower spaced-apart vertical ridges 26.

The cartridge rear surface 20 also includes a pair of horizontally spaced-apart ribs 28 projecting rearwardly that have rear surfaces 29. Each rib 28 has a horizontally extending aperture 30 facing outwardly for engagement by inwardly projecting jaws of a razor handle. The cartridge rear surface 20 also includes a central rearwardly projecting wall 32 with a camming surface 34 for engagement with a cartridge-pivoting element provided in some razor handles. Rounded surfaces 35 projecting from the cartridge rear surface 20 represent the tops of rivet pieces used in construction of the cartridge.

The razor handle 12 is a single piece open frame molded from a plastic and having dimensions that provide some resiliency in the frame elements. The handle 12 includes two spaced-apart vertical side walls 36. At the bottom 40 of the handle 12, the walls 36 are joined by a portion of the handle forming a base 42 of the handle. About a third of the way up the handle 12, the walls 36 are joined by a portion of the handle forming a spacer 44. Further up the handle 12, the walls 36 are joined by a portion of the handle forming a neck 46. The space between the walls 36 bound by the spacer 44 and the neck 46 form a slot 48 into which the walls, which are resilient by the nature and dimensions of the plastic material used to form the handle, can move if they are squeezed toward each other.

Above the neck 46, the razor handle walls 36 diverge to form jaw-like upper wall portions 50 with cartridge engaging end portions 52. The end portions 52 each comprise a surface 54 from which projects a base 56 for a horizontally inwardly extending finger 58 for engaging an aperture 30 of a cartridge rib 28. In the illustrated embodiment, each end portion 52 also includes a pad 60 for abutting the rear surface 29 of a cartridge rib 28 when the cartridge 10 and the handle 12 are engaged, to prevent pivotal movement of the cartridge about the fingers 58.

Figure 5:
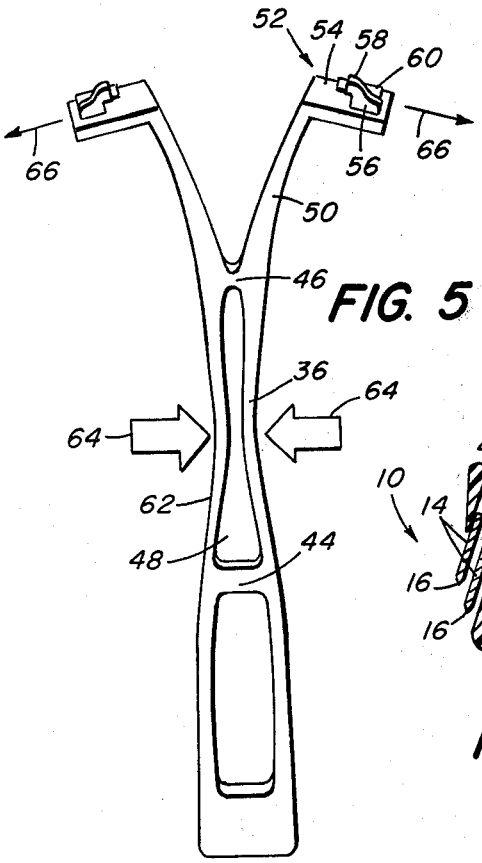
FIG. 5 is a view like FIG. 4 of the handle showing its configuration when the handle is squeezed.
Figure 3:
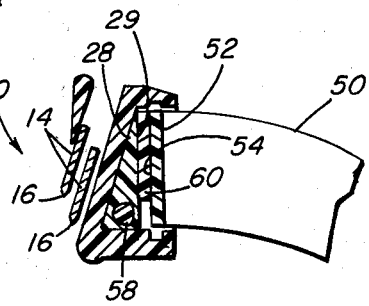
FIG. 3 is a side elevational view, partially in section through one of the cartridge ribs, showing the handle of FIG. 1 engaged with the blade cartridge.
Figure 4:
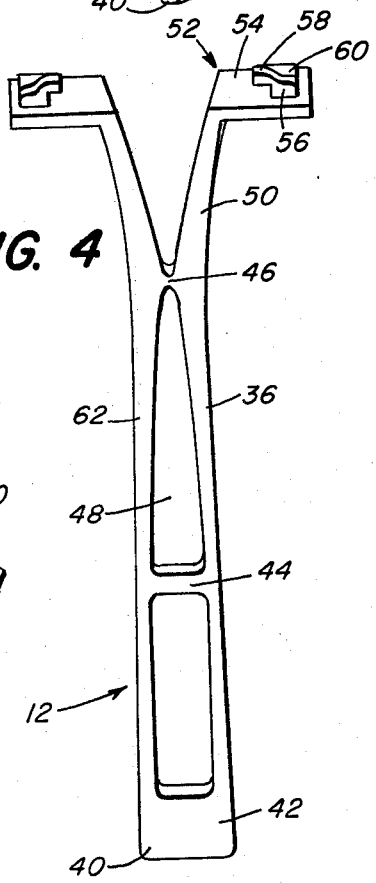
FIG. 4 is a front elevational view of the handle in its relaxed position.

With the configuration of the handle elements described, the lower portions 62 of the handle walls 36, that is, the portions between the handle neck 46 and the spacer 44 adjacent the slot 48, may be squeezed together in the directions of the arrows 64, shown in FIG. 5. When that is done, the upper wall portions 50 are urged outward, in the direction of the arrows 66, shown in FIG. 5, the handle neck 46 acting like a fulcrum about which the walls 36 pivot. Upon release of the walls 36, the resilience of the walls 36 causes them to return to their original spaced apart configuration and causes the upper portions 50 to close.

The razor handle 12 is used to engage a blade cartridge 10 by pinching, or squeezing, the lower portions 62 of the handle walls 36 at a point between the handle neck 46 and the handle spacer 44, preferably midway between the two. This spreads the wall upper portions 50. A blade cartridge, such as the cartridge 10 illustrated in this description of a preferred embodiment, is placed so that the pair of cartridge apertures 30 is between the fingers 58 projecting from the end portions 52 of the wall upper portions 50. The handle walls 36 are then released, and the upper portions 50 return to their original position, gripping the cartridge ribs 28 by way of the fingers 58 in the aperture 30. The pads 60 at the surface 54 of the upper wall ends 52 are located to abut the rear surfaces 29 of the blade cartridge ribs 28. A portion of the surface 54 at the end 52 of the upper wall portions 50 also abuts a portion of the peripheral wall 24 of the cartridge 10 to help prevent pivotal movement of the cartridge. In this way the pads 60 and surface 54 prevent pivotal movement of the cartridge 10 about the fingers 58.

When it is desired to discard the cartridge 10 and substitute a fresh one, the handle 12 is squeezed again to spread the upper wall portions 50, and the cartridge 10 is easily replaced.

Thus a simply manufactured one-piece handle 12 provides all the mechanism necessary to engage and disengage any razor blade cartridge 10 that is adapted to be gripped between projecting fingers of spreadable jaws. The natural resilience of the usual plastic material used for manufacturing inexpensive razor handles is taken advantage of in the construction. The resilience allows the lower wall portions 62 of the handle to be squeezed together easily, to be restored to their original configuration quickly, and to hold their original position firmly.

It would be possible for other elements of the handle frame, such as the spacer 44, to provide the resilience necessary for operation of the handle 12. With a resilient spacer 44, and no base portion 42, the walls 36 could be rigid and still pivot about the neck 46 to cause the upper wall portions 50 to spread apart. Under those circumstances, namely, rigid walls, the bottoms of the walls 36 would move closer together, and so the base portion 42 would have to be eliminated or be very resilient. Such an arrangement would, however, create an opportunity for inadvertently releasing the cartridge 10 by gripping the razor handle strongly during shaving.

In the preferred embodiment, the resilience of the lower wall portions 62 (the portions of the side walls 36 between the neck 46 and spacer 44) is used to advantage. Typically the flexibility is not so great that simple grasping of the handle will cause release of the cartridge, nor so little that great pressure must be put on the handle walls to disengage the cartridge.

The location of the spacer 44 has an effect on the flexibility of the handle walls 36. If it is placed near the bottom of the handle, the flexibility of the walls will increase because of the lengthening of the slot 48 between the walls. If the spacer 44 is placed nearer the handle neck 46, the flexibility and the resilience of the walls 36 will decrease.

Locating the spacer 44 some distance up from the bottom 40 of the handle 12 creates a portion of the handle between the spacer and the bottom that may be gripped as strongly as desired without affecting the portions of the walls 36 above the spacer. The portion between the spacer and the bottom of the handle may even be filled in if desired, though leaving an open area conserves the amount of material used in the manufacture of the handle.

The pads 60 shown in the illustrated embodiment are optional. They allow the user of the handle 12 to lock a pivotable razor cartridge in a non-pivotable position, which some shavers prefer. The configurations of the ends 52 of the upper wall portions 50 may be varied to make them suitable for a variety of blade cartridges. Typically, the end portions would be formed to allow use of the handle with as many kinds of blade cartridges as is feasible.

The neck 46 is shown in the embodiment described as an integral element joining the handle walls 36. All that is necessary, however, is that there be an element located between the walls about which they can pivot. It would be adequate, for example, if the walls had projecting elements that abut in the region of the neck. A split down the middle of the neck 46 would permit adequate operation of the handle, provided another portion of the handle did keep the handle walls joined.

Other modifications to, additions to, and deletions from the disclosed embodiment will be obvious to those skilled in the art and are within the scope of the following claims.

I claim:

1. In a razor system of the type including a separable blade cartridge having one or more blades each having a single cutting edge, said cartridge being formed with ribs having apertures and a slide, said cartridge being operable dually and selectively to make a pivotal connection with a handle having fingers or stub shafts insertable in said apertures and to make a sliding connection with a handle having a track for engaging said slide;

an improved plastic handle structure providing an alternative connection with said blade cartridge: comprising a pair of flexible arms joined to define a yoke, each yoke formed with a stub shaft operable to engage a mating aperture in said cartridge ribs and pads individual to each arm adjacent each stub shaft cooperating with mating ribs on said cartridge to block pivoting of the cartridge.

* * * * *